US005761928A

United States Patent [19]

Silveri

[11] Patent Number: 5,761,928

[45] Date of Patent: Jun. 9, 1998

[54] HOOP EARRING

[75] Inventor: Greg Silveri, Airmont, N.Y.

[73] Assignee: Jacmel Jewelry Inc., Long Island City, N.Y.

[21] Appl. No.: 755,026

[22] Filed: Nov. 22, 1996

[51] Int. Cl.[6] ..... A44C 7/00

[52] U.S. Cl. ..... 63/12

[58] Field of Search ..... 63/12, 13, 34, 63/35, 36, 7, 3, 5, 5.1; 420/511, 503

[56] References Cited

U.S. PATENT DOCUMENTS

| | | | |
|---|---|---|---|
| 1,139,309 | 5/1915 | Nesler | 63/12 |
| 1,189,882 | 7/1916 | Sommer | 63/3 X |
| 1,935,504 | 11/1933 | Hargreaves | 63/7 |
| 1,938,206 | 12/1933 | Bigney | 63/7 |
| 2,064,934 | 12/1936 | Marshall | 63/7 |
| 2,647,379 | 8/1953 | Ferro | 63/12 |
| 2,654,146 | 10/1953 | Mooradian | 420/511 X |
| 3,033,010 | 5/1962 | Pintarelli | 63/12 |
| 3,673,815 | 7/1972 | Pintarelli | 63/12 |
| 4,370,164 | 1/1983 | Harris et al. | 420/503 |
| 4,372,131 | 2/1983 | Musillo | 63/12 |
| 4,446,102 | 5/1984 | Bales | 420/511 X |
| 5,180,551 | 1/1993 | Agarwal | 420/511 |
| 5,372,779 | 12/1994 | Reti | 420/511 X |
| 5,384,089 | 1/1995 | Diamond | 420/511 |
| 5,429,795 | 7/1995 | Muller | 420/511 X |

*Primary Examiner*—David M. Purol

*Attorney, Agent, or Firm*—Gottlieb, Rackman & Reisman, P.C.

[57] ABSTRACT

A hoop earring design having a number of novel features is provided. The hoop earring of the invention includes a hoop portion as well as a lobe-connecting portion. The hoop portion is defined by a thin semi-spherical curved metal sheet having a pair of circumferential tubings along the outer edges thereof.

7 Claims, 2 Drawing Sheets

FIG.4
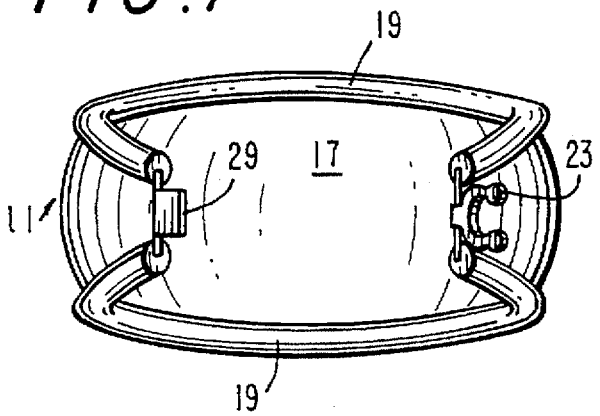
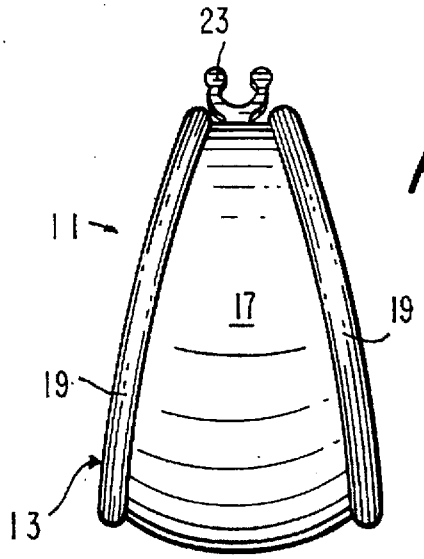
FIG.5
FIG.6
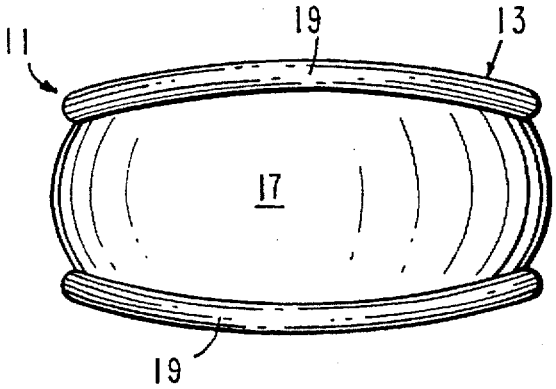

HOOP EARRING

BACKGROUND OF THE INVENTION

This invention relates to a hoop earring design, and more particularly to a hoop earring design which does not have sharp edges and which has a smooth flow in appearance.

One of the problems with many hoop earring designs is that sharp edges result from the manufacture process. While it would be possible to increase the gauge or thickness of the material used to form the hoop earring, this would undoubtedly increase the cost of producing the earring, as well as the weight of the earring, causing discomfort for the wearer.

Accordingly, it would be desirable to construct a hoop earring design which overcomes the above disadvantages.

SUMMARY OF THE INVENTION

Generally speaking, in accordance with the invention, a hoop earring design having a number of novel features is provided. The hoop earring of the invention includes a hoop portion as well as a lobe-connecting portion. The hoop portion is defined by a thin semi-spherical curved metal sheet having a pair of circumferential tubings along the outer edges thereof.

The tubing which is used at the edges of the earring design serves three functions. In the first place, it increases the strength of the earring piece. In addition, it enables smooth trimming of the earring piece during manufacture. Accordingly, even if the sheet of the hoop portion is constructed to be very thin in thickness, a smooth, unsharp edge along each side of the curved sheet is achieved. Moreover, since the tubing is lightweight, the weight of the hoop design earring is reduced, increasing the comfort of the wearer.

Significantly, the hoop design of the invention is made by using a heat-treatable material that can be formed into an earring design rather easily under controlled temperature and time treatment conditions. Additionally, the heat-treatable material is substantially lightweight and also resists denting during use.

Accordingly, it is an object of the invention to construct a novel hoop earring design.

Still another object of the invention is to provide a hoop earring design having smooth, unsharp edges.

Still a further object of the invention is to provide a hoop earring design whose manufacture is not cost prohibitive.

Yet a further object of the invention is to provide a hoop earring design which is resistant to denting.

Another object of this invention is to provide a hoop earring design which is light in weight.

Still other objects and advantages of the invention will in part be obvious, and will in part be apparent from the following description.

BRIEF DESCRIPTION OF THE DRAWINGS

For a fuller understanding of the invention, reference is made to the following description, taken in connection with the accompanying drawings, in which:

FIG. 4 is a top plan view of the hoop earring design;

FIG. 5 is a rear elevational view of the hoop earring design; and

FIG. 6 is a bottom plan view of the hoop earring design.

DETAILED DESCRIPTION OF THE PREFERRED EMBODIMENT

Figure 1:
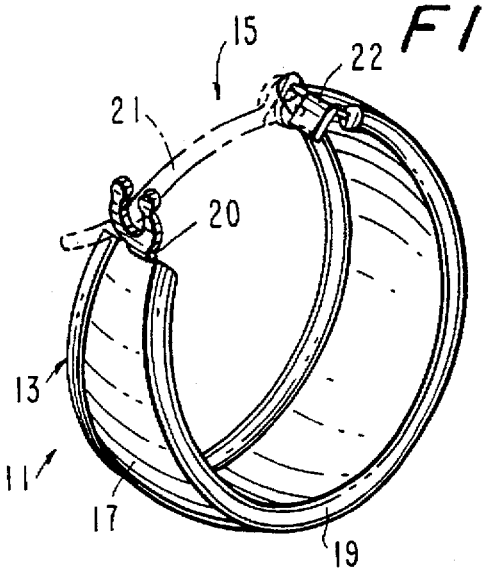
FIG. 1 is a perspective view of the hoop earring design.
Figure 3:
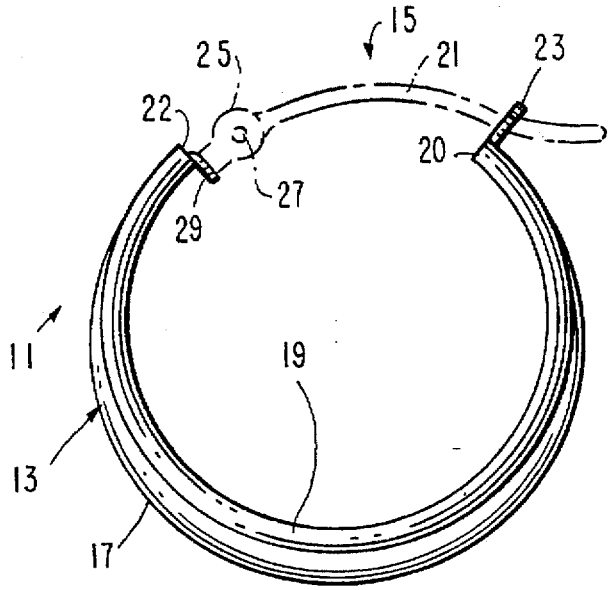
FIG. 3 is a side elevational view of the hoop earring design.
Figure 2:
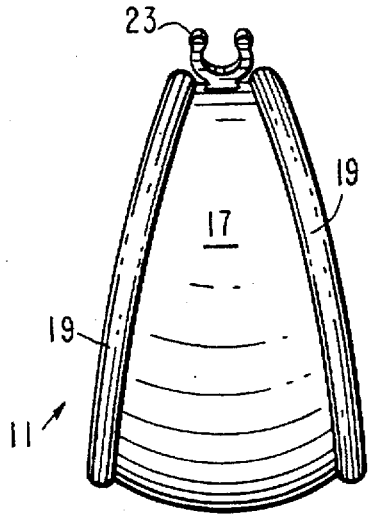
FIG. 2 is a front elevational view of the hoop earring design.

Referring in general to FIG. 1, as well as FIGS. 2–6, earring 11 of the invention is illustrated. Earring 11 comprises a hoop portion generally indicated at 13 and a lobe-connecting portion generally indicated at 15. Hoop portion 13 is defined by a semi-spherical curved sheet 17 having a pair of circumferential tubings 19 formed along the outer edges thereof. Tubings 19 increase the strength of earring 11 while at the same time allowing for smooth trimming of earring 11 during the manufacture thereof. Accordingly, and as can be appreciated, tubings 19 enable a smooth, unsharp edge to be created along sheet 17 of hoop portion 13.

Hoop portion 13 has a forward end 20 and a rearward end 22. Forward end 20 is formed with a catch 23. Rearward end 22 is formed with a pivot member 25 that is connected to end 22 by means of a tab 29. Pivot member 25 includes a rotatable pivot pin 27 to which a pivotally rotatable bar 21 is connected. Bar 21 and catch 23 are in combination used to attach earring 11 to the ear lobe of the wearer, as is well known in the art.

Earring 11 of the invention is preferably made from 14-karat or 10-karat gold composition. By way of example,

| | 14-karat |
|---|---|
| Gold | 57.50–60.00 |
| Silver | 8.00–35.00 |
| Copper | Balance |
| Zinc | 0.00–6.00 |
| | 10-karat |
| Gold | 40.00–45.00 |
| Silver | 8.00–35.00 |
| Copper | Balance |
| Zinc | 0.00–6.00 |

Significantly, for the gold composition, the silver content must be greater than 8% by weight (while maintaining a yellow color), while the zinc content should not exceed 6% by weight.

Although karat gold is the preferred composition, other heat treatable compositions may be used, such as compositions of white gold, copper-based alloys, silver-based alloys, and platinum.

Thus, both sheet 17 and tubing 19 of hoop portion 13 are preferably made from 14-karat or 10-karat gold.

Manufacture of earring 11 of-the invention is now described. Starting with a semi-spherical metal stamping with tabs (hoop portion 13), tubings 19 are slid along the edges of hoop portion 13 (tubings 19 have longitudinally extending open edges) and then soldered in place. Then, catch 23 and bar 21 (with pivot member 25) is soldered to the tabs at ends 20 and 22 respectively. Thereafter, a bead of solder is added to the back of tab 29 in order to add strength to the connection of pivot member 25 to end 22. After earring 11 is cleaned, it is assembled, and it is then heat-treated, polished and cleaned again.

In the inventive design, the preferred thickness of sheet 17 is between 0.003 and 0.006 inches. Moreover, the weight of earring 11 ranges from 0.35 to 0.75 penny weight. Finally, the hardest of the earring material is a dph of greater than 150 Vickers.

It will thus be seen that the objects set forth above, among those made apparent from the preceding description, are efficiently attained.

I claim:

1. An earring comprising a hoop portion and a lobe-connecting portion, wherein the improvement comprises the hoop portion being defined by a thin semi-spherical curved sheet having circumferential tubings along the outer edges thereof;

wherein said semi-spherical curved sheet has a thickness dimension between about 0.003 inches and 0.006 inches; and wherein the weight of said earring is from between about 0.35 to 0.75 pennyweight.

2. The earring of claim 1, wherein said lobe-connecting portion comprises a pivotally rotatable bar and a catch to which said rotatable bar is selectively connectible.

3. The earring of claim 1, wherein said hoop portion is made from a heat-treatable material.

4. The earring of claim 3, wherein said heat-treatable material is selected from compositions of the group consisting of karat gold, white gold, copper-based alloys, silver-based alloys and platinum.

5. The earring of claim 4, wherein the heat-treatable material is karat gold composition.

6. The earring of claim 5, wherein said composition has a silver content greater than 8% by weight and a zinc content not exceeding 6% by weight.

7. The earring of claim 1, wherein said earring is made of material having a hardness of dph about 150 Vickers.

* * * * *